United States Patent [19]

Frank

[11] 4,243,967

[45] Jan. 6, 1981

[54] THERMOSTAT AND METHOD OF OPERATING

[75] Inventor: James P. Frank, Rock Falls, Ill.

[73] Assignee: General Electric Company, Fort Wayne, Ind.

[21] Appl. No.: 5,236

[22] Filed: Jan. 22, 1979

[51] Int. Cl.[3] ..... H01H 37/52

[52] U.S. Cl. ..... 337/340; 74/480 R; 337/93; 337/346

[58] Field of Search ..... 337/340, 346, 93, 334, 337/335, 336, 337, 338, 369, 89, 90, 91, 93, 312, 44; 74/480

[56] References Cited

U.S. PATENT DOCUMENTS

| | | | |
|---|---|---|---|
| 3,087,032 | 4/1963 | Fleury | 337/37 |
| 3,249,721 | 5/1966 | Baak | 337/90 |
| 3,371,175 | 2/1968 | Benedik | 337/93 |
| 4,078,601 | 3/1978 | Kolbow | 337/340 |

*Primary Examiner*—Harold Broome
*Attorney, Agent, or Firm*—Joseph E. Papin

[57] ABSTRACT

A thermostat adapted to regulate the temperature of a given space. The thermostat has a temperature setting lever movable between a plurality of temperature settings within a pair of temperature ranges and also a mode selecting lever movable between a heating position, an off position and a cooling position. Means respectively associated with the temperature setting lever and the mode selecting lever is provided to effect the movement of the mode selecting lever from one of the heating position and cooling position thereof through its off position to the other of the heating position and cooling position thereof in response to the movement of the temperature setting lever from one of its temperature settings of the plurality thereof within one of the temperature ranges toward another of its temperature settings within the other of the temperature ranges.

A method of operating a thermostat is also disclosed.

26 Claims, 7 Drawing Figures

THERMOSTAT AND METHOD OF OPERATING

FIELD OF THE INVENTION

This invention relates generally to temperature reponsive devices and in particular to a thermostat and a method of operating a thermostat.

BACKGROUND OF THE INVENTION

Due to the recent emphasis on heating and cooling economy in order to conserve power and fuel, some of the prior art thermostats have been provided with various different schemes for effecting such economics. For instance, one of the prior art thermostats was operable in a heating mode within a temperature range of about 55° F. to 75° F. and obviated the ability to heat at temperatures in excess of this heating range. Also, this one prior art thermostat was operable in a cooling mode within a temperature range of about 75° to 95° F. and obviated the ability to cool at temperatures less than this cooling range. As a temperature indicating knob was rotated through these heating and cooling ranges to set a selected temperature for the given space in which the prior art thermostat was located, a clutch type device associated with the temperature indicating knob was operable to translate the rotation thereof into adjusting movement of a bimetal element for sensing the temperature of the given space. Thus, the adjusted position of the bimetal was correlative with the temperature set by the temperature indicating knob in the aforementioned heating and cooling temperature ranges. When the temperature indicating knob was rotated between the heating and cooling temperature ranges, the temperature indicating knob transcended an "off" space which was interposed between such ranges, i.e. between the respective 75° F. temperature settings thereof. Of course, as the temperature indicating knob was rotated through the "off" space between the heating and cooling temperature ranges, the clutch type device was actuated so as to interrupt the adjusting movement of the bimetal element in response to the rotation of the temperature indicating knob. Further, upon the rotation of the temperature indicating knob through the "off" space into either of the heating and cooling temperature ranges, a drive arm carried by the temperature indicating knob was drivingly engaged with a cam thereby rotating it in a direction to effect the chosen heating or cooling operating mode of the thermostat. Since the rotational movement of the temperature indicating knob to a temperature setting in either of the heating and cooling temperature ranges automatically effected the operating mode of the prior art thermostat, it is believed that at least one of the disadvantageous or undesirable features of such prior art thermostat was that no manual selection of the operating modes thereof was provided.

SUMMARY OF THE INVENTION

Among the several objects of the present invention may be noted the provision of an improved thermostat and an improved method of operating a thermostat which overcome at least the aforementioned disadvantageous or undesirable features, as well as others, of the prior art; the provision of such improved thermostat and method in which an operator is provided a "free-wheeling" free upon manual movement of a temperature setting means of the thermostat thus providing a positive indication that the thermostat is in its "off" operating mode; the provision of such improved thermostat and method in which a "resistance" feel is imparted to the manual movement by the operator of the temperature setting means from one of a predetermined heating temperature range and a predetermined cooling temperature range of the thermostat to the other thereof thus providing a positive indication of such manual movement to the operator; the provision of such improved thermostat and method in which a mode selecting means is both manually and automatically movable between a heating mode position, an off position and a cooling mode position for selecting the operating modes of the thermostat and wherein the manual movement of the temperature setting means between the predetermined heating and cooling temperature ranges of the thermostat effects only the automatic movement of the mode selecting means; the provision of such improved thermostat and method in which the predetermined heating and cooling temperature ranges may be easily changed or adjusted; and the provision of such improved thermostat which is simplistic in design, easily assembled and economically manufactured. These as well as other objects and advantageous features of the present invention will be in part apparent and in part pointed out hereinafter.

In general, a thermostat in one form of the invention is adapted to regulate the temperature of a space. In this thermostat, means is both manually movable and automatically movable between an off position, a heating mode position and a cooling mode position for selecting an operating mode of the thermostat, and means is manually movable for setting a selected temperature within a pair of predetermined temperature ranges when the mode selecting means is in the heating mode position and the cooling mode position thereof. Driving means respectively associated with the mode selecting means and the temperature setting means so as to define a lost motion connection therebetween is operable for effecting only the automatic movement of the mode selecting means from one of the heating mode position and the cooling mode position thereof through its off position to the other of the heating position and the cooling position thereof when the temperature setting means is manually moved from one of the predetermined temperature ranges to the other thereof.

Also in general and in one form of the invention, a method is provided for operating a thermostat adapted to regulate the temperature of a given space in which the thermostat may be located. The thermostat has means movable between an off position, a heating position and a cooling position for selecting the mode of operation of the thermostat, and means is provided for setting a preselected temperature of the space within a pair of predetermined temperature ranges. The method of operating the thermostat comprises adjusting the temperature setting means from a preselected temperature within one of the predetermined temperature ranges toward another preselected temperature setting thereof within the other of the predetermined temperature ranges and interconnecting the temperature setting means upon the adjustment thereof from the first named preselected temperature setting toward the another temperature setting in abutting relation with the mode selecting means so as to drive it from one of the heating position and the cooling position thereof through its off position to the other of the heating position and the cooling position thereof.

BRIEF DESCRIPTION OF THE DRAWINGS

Corresponding reference characters indicate corresponding parts throughout the several views of the drawing.

The exemplifications set out herein illustrate the preferred embodiments of the invention in one form thereof, and such exemplifications are not to be construed as limiting the scope of the invention or the disclosure thereof in any manner.

DETAILED DESCRIPTION OF THE PREFERRED EMBODIMENTS

Figure 1:
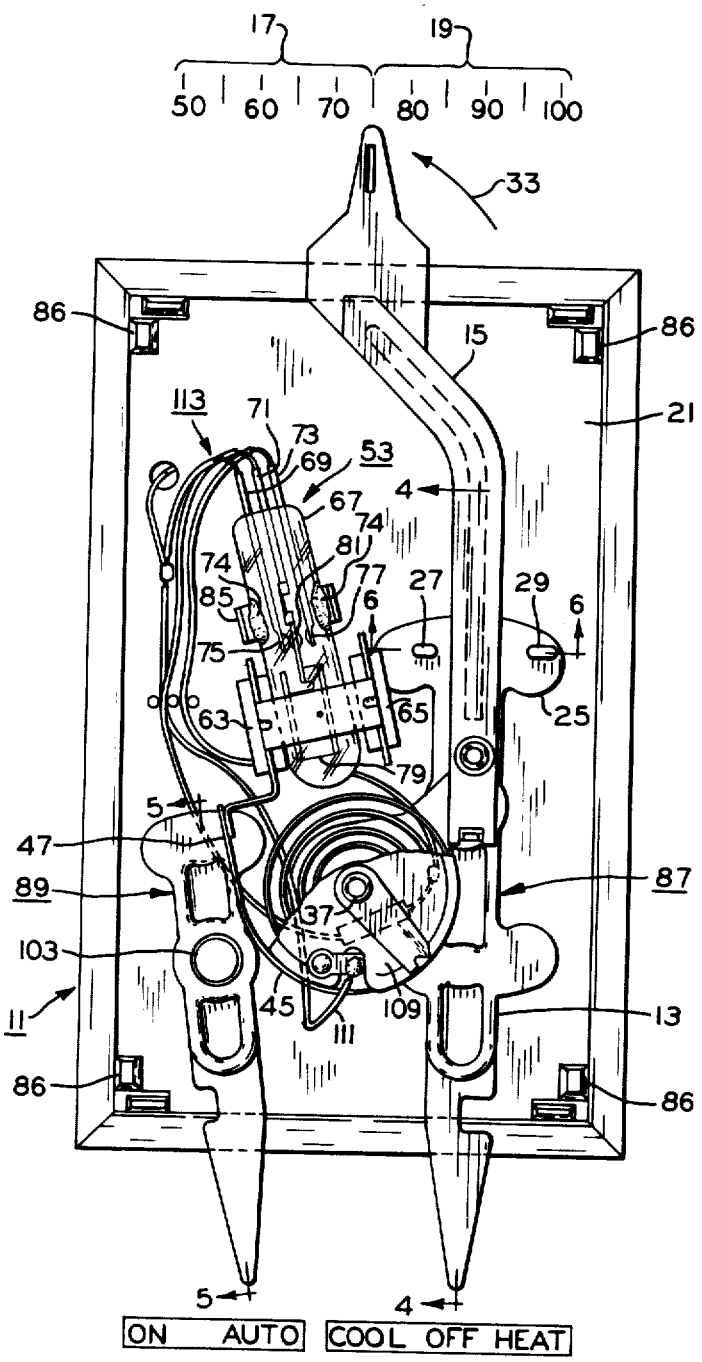
FIG. 1 is a plan view showing a thermostat in in one form of the invention with a cover thereof removed for clarity and illustrating principles which may be practiced in a method of operating a thermostat also in one form of the invention.

Referring now to the drawings in general, a method in one form of the invention is provided for operating a thermostat 11 adapted to regulate the temperature of a given space (not shown) in which the thermostat may be located (FIG. 1). Thermostat 11 includes means, such as a lever, lever means or switch arm 13, movable between an off position, a heating position and a cooling position for selecting the mode of operation of the thermostat and also means, such as another lever or lever means 15, for setting a preselected or set point temperature for the space within a pair of predetermined temperature ranges, such as a heating range 17 between about 50° to 75° F. and a cooling range 19 between about 75° F. to 90° F. for instance (FIGS. 1 and 4–6). In this operating method, temperature setting means or lever 15 is adjusted or otherwise manually moved from the set-point temperature thereof within one of predetermined temperature ranges 17,19 toward another set-point temperature within the other of predetermined temperature ranges 17,19, and upon this adjustment movement of the temperature setting lever, it is interconnected or otherwise engaged in abutting relation with mode selecting means or lever 13 so as to drive it from one of the heating and cooling positions thereof through its off position to the other of the heating and cooling positions thereof (FIGS. 1 and 4–6).

More particularly and with specific reference to FIGS. 1 and 4–6, system or mode selecting lever 13 and temperature setting lever or temperature selector 15 are each pivotally mounted or otherwise rotatably arranged on a base or mounting plate 21 of thermostat 11, as discussed in greater detail hereinafter, so as to be pivotally movable with respect to the base plate and also with respect to each other, and it may be noted that at least a part 23 of the temperature setting lever is disposed or otherwise arranged generally in overlaying or adjacent relation with at least another part, such as a pair of opposite extensions or ears 25 or the like for instance, of the mode selecting lever. A pair of predeterminately spaced apart abutments, such as raised nipples or tabs 27,29 or the like for instance, are respectively integrally provided on opposite ears 25 of mode selector lever 13, and abutment means, such as a depending ridge or land 31 or the like for instance, is integrally provided on temperature setting lever 15 and adapted for engagement with each of tabs 25,27. Thus, it may be noted that when mode selector lever 13 is disposed in its off position, as shown in FIG. 1, temperature setting lever 15 may be manually moved with respect to the mode selecting lever with a lost motion generally defined by a travel or distance S that tabs 27,29 are predeterminately spaced apart. In other words, the engagement of land 29 of temperature setting lever 15 with tabs 27,29 on mode selecting lever 13 defines a lost motion connection therebetween utilized to effect the automatic movement of the mode selecting lever when the temperature setting lever is manually moved between heating and cooling temperature ranges 17,19, as discussed in greater detail hereinafter. Upon the lost motion movement of temperature setting lever 15 with respect to mode selecting lever 13 in its off position, it may also be noted that the temperature setting lever is movable with a "free-wheeling" feel, i.e. generally without resistance opposition through at least a part of each of heating and cooling temperature ranges 17,19.

With mode selecting lever 13 in the off position thereof, temperature setting lever 15 may be manually pivoted or moved in a counter-clockwise direction as indicated by directional arrow 33 in FIG. 1, toward a set-point within heating temperature range 17. Initially this counter-clockwise movement of temperature setting lever 15 effects the lost motion connection or driving engagement of land 31 with tab 27 of mode selecting lever 13, and thereafter further counterclockwise movement of the temperature setting lever effects the conjoint pivotal or driven movement therewith of the mode selecting lever from its off position to its heating or heat mode operating position. It may be noted that the conjoint movement of mode selecting lever 13 with temperature setting lever 15 offers a "resistance" feel, i.e. an increased load type feel, to the operator so that the operator is aware that a mode operation selection is taking place. Thus, in response to the aforementioned manual operation or movement of temperature setting lever 15, mode selecting lever 13 is automatically operated or moved to its heat position thereby to place thermostat 11 in its heat operating mode. When mode selecting lever 13 so located in its heating position, temperature setting lever 15 may be manually moved to a set point temperature within predetermined heating temperature range 17 so as to set the temperature for the given space, and it may be noted that the predetermined space or distance S between tabs 27,29 through which land 31 is movable limits the manual movement of the temperature setting lever to set points within the predetermined heating temperature range, i.e. between about 50° F. and 75° F. Thus, the limited lost motion movement of temperature setting lever 15 with respect to mode selecting lever 13, i.e. between tabs 27,29, when in the heating position thereof, defines the extent or predetermines the plurality of set-points through which the temperature setting lever is movable within predetermined heating temperature range 17. While tabs 27,29 and land 31 have been described herein as being on mode selecting lever 13 and temperature setting lever 15, respectively, it is contemplated that land 31 could be a part of mode selecting lever 13 and that tabs 27,29 could be parts of temperature setting lever 15 within the scope of the invention so as to meet the objects and advantageous features thereof.

In the event it is desired to move temperature setting lever 15 toward predetermined cooling temperature range 19 when mode selecting lever 13 is in its off position, the temperature setting lever may be manually moved or pivoted in a clockwise direction, i.e. opposite directional arrow 33 in FIG. 1. Initially this clockwise movement of temperature setting lever 15 effects the lost motion connection or driving engagement of land 31 thereof with tab 29 of mode selecting lever 13, and thereafter further clockwise movement of the temperature setting lever effects the conjoint pivotal or driven movement therewith of the mode selecting lever from its off position to its cool or cooling mode operating position. Thus, in response to the aforementioned clockwise manual operation or movement of temperature setting lever 15, mode selecting lever 13 is automatically operated or otherwise moved to its cooling position thereby to place thermostat 11 in its cooling operating mode. When mode selecting lever 13 is so located in its cooling position, temperature setting lever 15 may be manually moved to a set point temperature within predetermined cooling temperature range 19 so as to set the temperature for the given space, and it may be noted that the predetermined space or distance S between tabs 27,29 through which land 31 is movable limits the manual movement of the temperature setting lever to set points within the predetermined cooling temperature range, i.e. between about 75° F. and 90° F. Thus, the limited lost motion movement of temperature setting lever 15 with respect to mode selecting lever 13, i.e. between tabs 27,29, when the mode selecting lever is in the cooling position thereof, defines the extent or predetermines the plurality of set points through which the temperature setting lever is movable within predetermined cooling temperature range 19.

With reference again in general to the drawings and recapitulating at least in part with respect to the foregoing, thermostat 11 in one form of the invention is provided with mode selecting lever 13 which is both manually movable and automatically movable between its off position, its heat position and its cool position so as to select the operating mode of the thermostat, and temperature setting lever 15 is manually movable so as to set the set point or preselected temperature within predetermined heating and cooling ranges 17,19 when the mode selecting lever is in the heating mode position and the cooling mode position thereof (FIG. 1). Driving means, such as tabs 27,29 and land 31, respectively associated with mode selecting lever 13 and temperature setting lever 15 so as to define the lost motion connection therebetween, is provided for effecting only the automatic movement of the mode selecting lever from one of the heating and cooling mode positions thereof through its off position to the other of the heating and cooling mode positions thereof when the temperature setting lever is manually moved from one of predetermined temperature ranges 17,19 to the other thereof (FIGS. 1 and 4–6).

Figure 2:
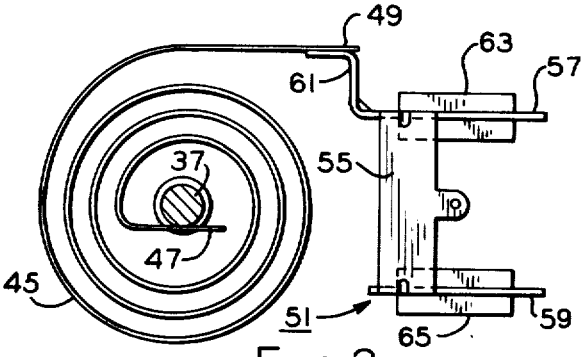
FIG. 2 is a fragmentary view taken from FIG. 1 showing a switch operation effecting means assembly with an anticipator removed therefrom for clarity.
Figure 3:
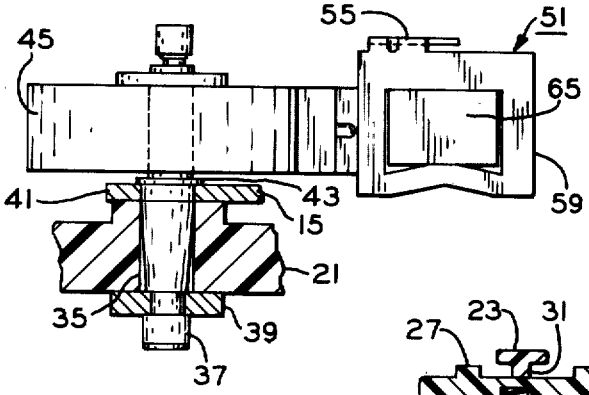
FIG. 3 is a side elevational view of the assembly of FIG. 2 partially in section to illustrate the mounting thereof to a base plate of the thermostat.
Figure 6:
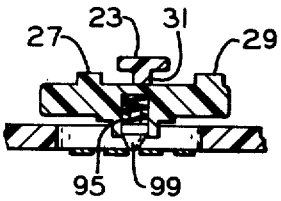
FIG. 6 is a sectional view taken along line 6—6 in FIG. 1.

More particularly and with specific reference to FIGS. 1–3, base plate 21 of thermostat 11 is provided with an opening 35 therethrough in which a post or shaft 37 is rotatably mounted, as best seen in FIG. 3. Shaft 37 is retained against displacement from opening 35 by a retainer, such as a C-washer 39 or the like for instance, which is received on the shaft and rotatably engaged with base plate 21 and also by a bifurcated end 41 of temperature setting lever 15 which is inserted into gripping engagement with the shaft between a shoulder 43 thereof and the base plate. Thus, the gripping engagement of bifurcated end 39 of temperature setting lever 15 effects the rotation of shaft 39 in opening 35 of base plate 21 conjointly with the manual movement of the temperature setting lever, as previously mentioned.

Means, such as a bimetal element 45 or the like for instance, is provided for sensing the prevailing temperature of the space in which thermostat 11 may be located. Sensing means or bimetal element 45 has a generally spiral configuration with a pair of generally radially spaced inner and outer end portions 47,49, as best seen in FIG. 2. Radially inner end 47 of bimetal element 45 is attached by suitable means, such as soldering or welding or the like for instance, to shaft 37 so as to be conjointly rotatable or otherwise movable therewith, and radially outer end 49 of the bimetal element is also attached by suitable means, such as soldering, welding or crimping or the like for instance, to means, such as a mounting or carrying bracket 51 or the like for instance, for translating temperature sensing movement of the bimetal element so as to effect the actuation of a switch device 53, as discussed hereinafter.

Bracket 51, which is formed of a non-ferrous material, is provided with a cross-piece 55 having a pair of integral oppositely spaced arms or flanges 57,59 respectively depending therefrom, and depending arm 57 is provided with an integral tab 61 which is suitably attached to radially outer end portion 49 of bimetal element or bimetal means 45, as previously mentioned. A pair of magnetic material elements or magnets 63,65 are predeterminately disposed or otherwise arranged in assembly relation with arms 57,59 of bracket 51, and the magnets may be Plastiform permanent magnets available from the 3M Company, 3M Center, St. Paul, Minn. As best seen in FIG. 1, bracket 51 and magnets 63,65 carried thereby are arranged in assembled relation with switch device 53 so that the magnets are disposed in straddling relation therewith, i.e. on opposite sides of the switch device.

Switch device 53 is constructed so that the component parts thereof are disposed generally in magnetic symmetry with respect to each other, as discussed hereinafter. Switch device 53 is provided with a generally elongate, cylindric hollow tube or casing 67 formed of a non-magnetic material, such as glass or the like for instance. Three terminals 69,71,73 are predeterminately and sealably disposed generally in side-by-side relation in casing 67 so that electrical connection sections of the terminals extend exteriorly of the casing for connection in an electrical circuit (not shown) of thermostat 21, and switch means supporting sections of the three terminals are disposed within the casing, respectively. A pair of opposed, predeterminately spaced apart contacts 75,77 are carried on the supporting sections of terminals 69,73, and an armature 79 is movably secured to the supporting section of terminal 71. Armature 79 has a double contact 81 thereon spaced generally equidistantly between contacts 75,77 for respective making engagement therewith upon movement of the armature when magnets 63,65 are moved into magnetic attraction therewith, as discussed hereinafter. Casing 67 of switch device 53 is secured or otherwise assembled by suitable means, such as a sealant 74 of epoxy or silicone cement or the like for instance, to seating means 85 integrally formed on base plate 21, and when so secured to the seating means, the switch device is arranged so that armature 79 thereof extends generally along a radius line (not shown) emanating from the centerline axis of opening 35 in the base plate.

Figure 4:
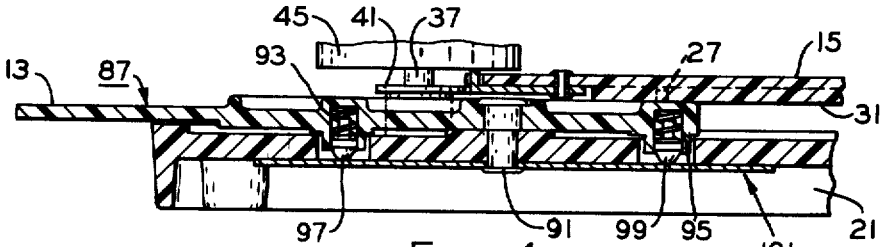
FIG. 4 is a sectional view taken along line 4—4 in FIG. 1.
Figure 5:
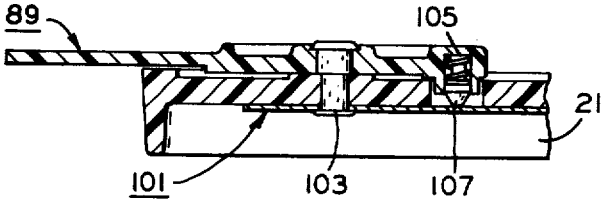
FIG. 5 is a sectional view taken along line 5—5 in FIG. 4.

Base plate 21 of thermostat 11 is provided with means, such as a plurality of split posts 86 or the like respectively at each corner of the base plate, for releasable securing engagement with a cover (not shown) for the thermostat, and such cover may contain temperature setting indicia, such as predetermined temperature ranges 17,19, as well as other indicia concerning the settings or positions of both a system or mode selector switch and a fan switch indicated generally at 87,89, respectively. Mode selector switch 87, as best seen in FIG. 4, includes mode selecting lever 13 which is pivotally or rotatably mounted on a post or pin 91 secured to base plate 21, and the lever is provided with a pair of spaced apart recesses 93,95 which house a pair of spring loaded, indexing type contacts 97,99, respectively. Contacts 97,99 are resiliently urged toward electrical contacting engagement with a stamped-out metallic circuit board or plate indicated generally at 101. Of course, mode selecting lever 13 is both automatically and manually pivotally movable about pivot pin 91 between the aforementioned heat, off and cool positions thereof so as to effect the desired operating mode of thermostat 11, and upon such pivotal movement of the mode selecting lever, contacts 97,99 are respectively urged or indexed into electrical contacting engagement between various stamped-out parts (not shown) of circuit plate 101 to effect the heating or cooling mode operation of the thermostat or to turn off the thermostat. As best seen in FIG. 5, fan switch 89 is pivotally or rotatably mounted on a pivot post or pin 103 secured to base plate 21 and also has a recess 105 in which another spring loaded, indexing type contact 107 is housed so as to be urged toward electrical contacting engagement with circuit plate 101. Of course, fan switch 89 is manually pivotally movable about pivot pin 103 between an on position and an automatic position so as to select the desired operation of a fan or blower (not shown) during the heating and cooling mode operation of thermostat 11. If a more detailed discussion of the circuitry included in circuit plate 101 is desired, reference may be had to the thermostat circuitry disclosed in the Wiley M. Hummel U.S. Pat. No. 4,016,520 issued Apr. 5, 1977 which is incorporated herein by reference.

As shown in FIG. 1, a heat anticipator assembly 109 is secured to the upper end of shaft 37 so as to extend generally adjacent and over bimetal element 45 which is secured to the shaft, as previously discussed. Heat anticipator assembly 109 is connected by a lead 111 in circuit relation with circuit plate 101, and when energized the heat anticipator is operable to supply or transmit heat directly to bimetal element 45 so as to prevent temperature overshoot or undershoot, as is well known in the art. To complete the description of thermostat 11, a plurality of leads indicated generally at 113, are respectively connected in circuit relation between the electrical connector sections of terminals 69,71,73 of switch device 53 and circuit plate 101 so that the switching operation of the switch device is effective when mode selector switch is disposed in its heating and cooling operating mode position. With the exception of the temperature interlock or lost motion connection between mode selecting lever 13 and temperature setting lever 15, as previously described, the other components of thermostat 11 are disclosed in the Ralph A. Gustafson application Ser. No. 845,383 filed Oct. 25, 1977 which is incorporated herein by reference, and if a more detailed discussion of the construction, operation, assembly and calibration of such other components is desired, reference may be had to the above mentioned application.

In the manual operation of thermostat 11, if an operator desires to effect the heating mode operation thereof so as to effect heating of the space in which the thermostat may be located, mode selecting lever 13 of mode selector switch 87 is manually pivoted about pivot pin 91 to its heat position so as to index contacts 97,99 into positions in electrical contacting engagement with circuit plate 101 effecting the heating mode operation of the thermostat, FIGS. 1 and 4. Of course, fan switch 89 may also be manually pivoted about pivot pin 103 so as to index contact 107 into a position in electrical contacting engagement with circuit plate 101 effecting a desired one of the on position or the automatic position of the fan switch, as desired, FIGS. 1 and 6. Upon the manual movement mode selector switch 87 to its heat position, as discussed above, the operator may now select a set-point temperature desired for the space in which thermostat 11 is located by manually moving temperature setting lever 15 toward the desired or selected temperature setting thereof within predetermined temperature range 17, as previously mentioned. The operator applied force of manual movement or rotation of temperature setting lever 15 effects the conjoint rotation therewith of shaft 37 within opening 35 of base plate 21, FIG. 3, and since bimetal element 45 is carried on the shaft, the bimetal element is conjointly rotatable therewith to an adjusted position correlative with the set-point temperature indicated by temperature setting lever 15. Of course, this conjoint rotation of bimetal element 45 with shaft 37 is translated by carrying bracket 51 into conjoint pivotal movement or rotation of magnets 63,65 about the shaft. Thus, as the torque of bimetal element 45 exceeds the magnetic attraction between armature 79 of switch device 53 and magnet 63, magnets 63,65 are rotated generally in the counterclockwise direction about shaft 37 with snap action; therefore, magnet 65 is, positioned farther away from armature 79 of switch device 53 so as to decrease the magnitude of the magnetic coupling or attraction force therebetween. When the magnitude of the magnetic attraction force between armature 79 and magnet 63 exceeds that between the armature and magnet 65, the armature will move or snap in a direction toward magnet 63 so as to break double contact 81 from contact 77 and make the double contact with contact 75. Thus, as shown in FIG. 1, in the aforementioned adjusted position of bimetal element 45, magnet 63 is disposed in abutment with the sidewall of casing 67 of switch device 53, and armature 79 is attracted in magnetic coupling relation toward magnet 63 so as to make double contact 81 on the armature with contact 75 of the switch device. When double contact 81 is engaged with contact 75, a heating system (not shown) is enabled or energized for conditioning the air of the space in which thermostat 11 is located since system selector switch 87 is in its heat mode position, as previously mentioned.

Of course, bimetal element 45 is also movable in its adjusted position with respect to shaft 37 so as to generally wind and unwind in the clockwise and counterclockwise directions thereabout, respectively, in response to the particular temperature of the space sensed by the bimetal element. With the temperature of the space being increased or heated upon the enablement of the heating system and/or anticipator 109, bimetal element 45 expands creating a force tending to move or rotate its radially outer end 49 generally in the counterclockwise direction with respect to shaft 37. This increasing torque on bimetal element outer end 49 conjointly pivotally urges carrying bracket 51 and magnets 63,65 in the counterclockwise direction with respect to shaft 37. Thus, as the temperature of the space is increased to the set point or preselected temperature, the magnitude of the expansive force of bimetal element 45 exceeds that of the attraction force between magnet 63 and armature 79 so that bracket 51 will move its magnets 63,65 with snap action in the counterclockwise direction about shaft 37 toward a position in which magnet 65 is disposed in engagement with the sidewall on casing 67 of switch device 53. Thus, upon this temperature sensing rotation of bimetal element 45 in its adjusted position, armature 79 is attracted in magnetic coupling relation toward magnet 65 so as to make double contact 81 on the armature with contact 77 of the switch device since the attraction force between the armature and magnet 65 is now greater than that between the armature and magnet 63. When double contact 81 is so engaged with contact 77, the heating system is disabled or deenergized as well as heat anticipator assembly 109.

With the heating system so deenergized, the temperature of the conditioned air in the space in which thermostat 11 may be located, of course, falls, and at a preselected differential in excess of the selected temperature setting, bimetal element 45 will contract to a degree creating a contractive force to effect the return conjoint rotation with snap action of carrying bracket 85 and magnets 63,65 to their respective adjusted positions, as previously mentioned, thereby to re-energize the heating system to again increase the temperature of the conditioned air in the space to the selected temperature. Upon the return rotation of magnets 63,65 to the adjusted position of bimetal 45, as previously discussed, armature 79 is attracted in magnetic coupling relation toward magnet 63 so as to disengage double contact 81 from contact 77 and remake the double contact with contact 75 of switch device 53. Of course, this operation of bimetal element 45, bracket 51 and magnets 63, 65 associated therewith to effect the switching operation of switch device 53, as previously mentioned, in order to control the heating system may be cyclically or periodically repeated in response to the temperature demands of the space in which thermostat 11 is located so as to generally maintain the selected temperature of the space.

Further, if the operator desires to effect the cooling operating mode of thermostat 11, mode selecting lever 13 of selector switch 87 is manually rotated from its "heat" position to its "cool" position so as to enable or energize a cooling system for conditioning the air of the space in which thermostat 11 is located, and the component parts of the thermostat function in the same manner as previously described in order to control the operation of the cooling system in response to the temperature demands of the space so as to generally maintain the selected temperature of the space.

In the light of the previously discussed automatic operation of mode selecting lever 15 of switch 87 in response to the manual movement of temperature setting lever between predetermined temperature ranges 17,19, it may be noted that when mode selector switch 87 is manually actuated to its heat position and cool position, the lost motion connection between tabs 27,29 thereof and land 31 of the temperature setting lever also defines or limits the manual movement thereof only to set points within the predetermined temperature ranges, respectively.

Figure 7:
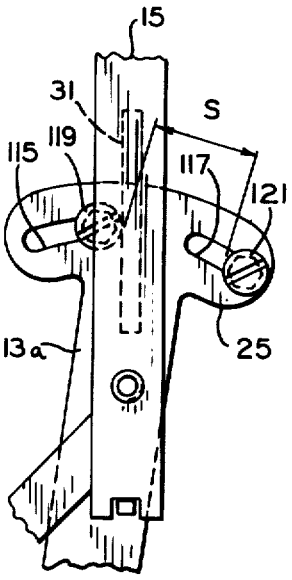
FIG. 7 is a fragmentary plan view of an alternative thermostat in one form of the invention illustrating means for altering the predetermined heating and cooling temperature ranges of the thermostat.

Turning now to FIG. 7, an alternative construction in one form of the invention comprising another mode selecting lever **13*a* for thermostat 11 is shown, and mode selecting lever 13*a* has generally the same component parts and functions in the thermostat generally in the same manner as the previously described mode selecting lever 13** with the following exceptions. While this alternative construction meets at least some of the objects and advantageous features discussed hereinabove, it may be noted that such alternative construction also has indigenous objects and advantageous features which will be either pointed out or become apparent in the following description thereof.

In opposite ears 25 of mode selecting lever **13*a*, there is provided a pair of slots 115,117 in which a pair of abutments, such as for instance a pair of threadedly engaged screw and nut assemblies 119,121 or the like for instance, are adjustably movable or slidable toward desired adjusted positions with respect to each other and in which the screw and nut assemblies may be tightened into fixed or gripping engagement with the temperature setting lever, respectively. Thus, by adjustably moving abutments 117,119 to preselected adjusted positions on temperature setting lever 15, the distance or span S between such abutments may be adjusted or preselected. Since land 31 on temperature setting lever 15 defines a lost motion connection with adjustable abutments 117,119, the distance S therebetween, of course, defines the lost motion through which the temperature setting lever may be moved between the adjustable abutment, and it may be noted that such lost motion, in turn, defines the plurality of set points within predetermined heating and cooling temperature ranges 17,19 through which the temperature setting lever may be moved. Thus, by adjusting the distance S between adjustable abutments 117,119, the predetermined temperature ranges 17,19** may also be adjusted and defined as well as the set point temperatures dividing such predetermined temperature ranges.

From the foregoing it is now apparent that a novel thermostat 11 and method of operating such are presented meeting at least the objects and advantageous features set out hereinbefore, and it is contemplated that changes as to the precise arrangements, shapes, connections and details of the constructions illustrated herein by way of example for purposes of disclosure, as well as the precise steps and order thereof of the method, may be made by those having ordinary skill in the art without departing from the spirit of the invention or the scope thereof as defined by the claims which follow.

What I claim as new and desire to secure by Letters Patent of the United States is:

1. A thermostat adapted to control the energization of a conditioning system operable generally in a heating mode and a cooling mode so as to effect the regulation of the temperature of a given space in which the thermostat may be located, the thermostat comprising:

a casing including a base;

a post rotatably mounted to said base;

a bimetal means movable in respective ones of a plurality of adjusted positions for sensing the temperature of the space, said bimetal means having a generally spiral configuration with generally radially spaced inner and outer ends and said inner end being secured to said post so as to be conjointly rotatable therewith;

means mounted to said base for selecting an operating mode of the thermostat and movable between an off position, a heating mode position and a cooling mode position;

a switch device mounted to said base and including means operable generally for switching between a pair of switching positions effecting the energization and the deenergization of the conditioning system when said mode selecting means is in the heating mode position and the cooling mode position thereof, respectively;

means secured generally to said outer end of said bimetal means and associated with said switch device for translating the temperature sensing movement of said bimetal element so as to effect the operation of said switching means between its switching positions;

a temperature selector manually movable with respect to said base within a pair of predetermined temperature ranges so as to set a preselected temperature for the given space and operably connected with said post so as to conjointly rotate said post and said bimetal means to a respective one adjusted position of the plurality thereof correlative with the preselected temperature setting of said temperature selector within one of the predetermined temperature ranges upon the manual movement of said temperature selector;

a pair of predeterminately spaced apart abutments on one of said mode selecting means and said temperature selector; and abutment means on the other of said mode selecting means and said temperature selector, one of said abutment pair and said abutment means being movable with lost motion with respect to the other of said abutment pair and said abutment means so as to drivingly engage one of said abutments of said pair thereof and said abutment means upon the manual movement of said temperature selector from the preselected temperature setting thereof within the one predetermined temperature range toward another preselected temperature setting thereof within the other of the predetermined temperature ranges, the driving engagement of said one abutment and said abutment means effecting the conjoint movement with said temperature selector of said mode selecting means from one of the heating mode position and the cooling mode position thereof through the off position to the other of the heating position and the cooling position and the lost motion movement between said abutments and said abutment means defining a manual movement of said temperature selector across at least a part of each of the one and other predetermined temperature ranges when said mode selecting means is in its off position.

2. A thermostat adapted to regulate the temperature of a space in which the thermostat may be located, the thermostat comprising:

a mode selector lever arranged in the thermostat so as to set the operating mode thereof and movable between an off position, a heating mode position and a cooling mode position;

a temperature selector lever manually movable in the thermostat so as to effect the setting of preselected temperatures within a pair of predetermined temperature ranges for the space and having at least a part thereof arranged generally in adjacent relation with at least another part of said mode selector lever; and means respectively associated with said at least another part of said mode selector lever and said at least part of said temperature selector lever so as to define a lost motion connection therebetween for driving said mode selector lever from one of the heating mode positions and the cooling mode position thereof through its off position into the other of the heating mode position and the cooling mode position thereof in response to the manual movement of the temperature selector lever from its preselected temperature setting within one of the predetermined temperature ranges toward another preselected temperature setting within the other of the predetermined temperature ranges and said temperature selector lever being movable within the lost motion connection with respect to said mode selector lever across at least a part of each of the predetermined temperature ranges when said mode selector lever is in its off position.

3. A thermostat as set forth in claim 2 wherein said driving means comprises a pair of predeterminately spaced apart abutments on one of said at least another part of said mode selector lever and said at least part of said temperature selector lever, and abutment means on the other of said at least another part of said mode selector lever and said at least part of said temperature selector lever and movable between said abutments for respective engagement therewith.

4. A thermostat as set forth in claim 3 wherein at least one of said abutments is adjustably movable with respect to the other thereof.

5. A thermostat as set forth in claim 2 further comprising a bimetal means conjointly movable with said temperature selector lever to an adjusted position correlative with the preselected temperature setting of said temperature selector lever and operable generally in the adjusted position for sensing the temperature of the space.

6. A thermostat as set forth in claim 4 further comprising a switch device adapted for operation between a pair of switching modes, and means associated with said bimetal means and operable in response to the temperature sensing movement thereof for effecting the operation of said switch device to one of its switching modes.

7. A thermostat adapted to regulate the temperature of a given space, the thermostat comprising:

means for selecting an operating mode of the thermostat and movable between an off position, a heating mode position and a cooling mode position;

means movable for setting a selected temperature within a pair of predetermined temperature ranges when said operating mode selecting means is in its heating mode position and its cooling mode position, respectively, and said temperature setting means including at least a part arranged at least generally adjacent at least another part of said operating mode selecting means;

a pair of abutments predetermined spaced apart on one of said at least part of said temperature setting means and said at least another part of said operating mode selecting means;

abutment means on the other of said at least part of said temperature setting means and said at least another part of said operating mode selecting means for lost motion engagement with said abutments, one of said abutment pair and said abutment means being conjointly movable with said temperature setting means so as to effect the lost motion engagement of one of said abutments and said abutment means and thereafter effect the movement of said operating mode selecting means from one of the heating mode position and the cooling mode position thereof through its off position toward the other of the heating mode position and the cooling mode position upon the manual movement of said temperature setting means from one of its preselected temperature settings within one of the predetermined temperature ranges toward another preselected temperature setting within the other of the predetermined temperature ranges.

8. A thermostat as set forth in claim 7 wherein said one of said abutment pair and said abutment means is movable through the lost motion with respect to the other of said abutment pair and said abutment means conjointly with said temperature setting means upon the manual movement thereof through at least a part of each of the predetermined temperature ranges when said operating mode selecting means is in its off position.

9. A thermostat as set forth in claim 7 wherein at least one of said abutments is adjustably movable with respect to the other thereof to alter the lost motion movement of said temperature setting means with respect to said mode selecting means.

10. A thermostat adapted to regulate the temperature of a space; the thermostat comprising:

means both manually movable and automatically movable between an off position, a heating mode position and a cooling mode position for selecting an operating mode of the thermostat;

means manually movable for setting a selected temperature within a pair of predetermined temperature ranges when said mode selecting means is in the heating mode position and the cooling mode position thereof; and driving means respectively associated with said mode selecting means and said temperature setting means so as to define a lost motion connection therebetween for effecting only the automatic movement of said mode selecting means from one of the heating mode position and the cooling mode position through its off position to the other of the heating position and the cooling position thereof when said temperature setting means is manually moved from one of the predetermined temperature ranges to the other thereof.

11. A thermostat as set forth in claim 10 wherein said temperature setting means is movable through the lost motion with respect to the mode selecting means across at least a part of each of the predetermined temperature ranges when the mode selecting means is in its off position.

12. A thermostat as set forth in claim 10 wherein said driving means comprises a pair of predeterminately spaced apart abutments on one of said mode selecting means and said temperature setting means, and abutment means on the other of said mode selecting means and said temperature setting means and movable between said abutments for respective engagement therewith.

13. A thermostat as set forth in claim 10 further comprising means conjointly movable with said temperature setting means to an adjusted position correlative with the preselected temperature setting of said temperature setting means and movable in the adjusted position with respect to said temperature setting means for sensing the temperature of the space.

14. A thermostat as set forth in claim 13 further comprising a switch device adapted for operation between a pair of switching modes, and means connected with said sensing means and operable generally in response to the temperature sensing movement of said sensing means in its adjusted position for effecting the operation of said switch device to one of its switching modes when said mode selecting means is in the heating mode position and the cooling mode position thereof, respectively.

15. A thermostat as set forth in claim 13 wherein said sensing means comprises a bimetal element.

16. A thermostat as set forth in claim 10 wherein said temperature setting means and said mode selecting means comprise a pair of levers pivotally mounted in the thermostat, respectively, and one of said levers being arranged at least in part in overlaying relation with the other of said levers.

17. A thermostat as set forth in claim 16 wherein said driving means comprises a pair of predeterminately spaced apart abutments on one of said one and other levers, and abutment means on the other of said one and other levers and movable with respect to said abutments so as to define the lost motion connection therewith, respectively.

18. In a thermostat adapted to regulate the temperature of a given space in which the thermostat may be located, the thermostat having means movable between an off position, a heating position and a cooling position for selecting the mode of operation of the thermostat, and means for setting a preselected temperature of the space within a pair of predetermined temperature ranges, a method of operating the thermostat comprising: adjusting the temperature setting means from a preselected temperature within one of the predetermined temperature ranges toward another preselected temperature setting thereof within the other of the predetermined temperature ranges and interconnecting the temperature setting means upon the adjustment thereof from the first named preselected temperature setting toward the another temperature setting in abutting relation with the mode selecting means so as to drive it from one of the heating position and the cooling position thereof through its off position to the other of the heating position and cooling position thereof.

19. The method as set forth in claim 18 wherein the adjusting and interconnecting step comprises moving the temperature setting means through at least a part of a predetermined lost motion with respect to the mode selecting means into driving engagement therewith and then conjointly driving the mode selector switch from the one of the heating position and the cooling position thereof through its off position to the other of the heating position and cooling position thereof upon the adjustment of the temperature setting means from the first named preselected temperature setting toward the another preselected temperature setting thereof.

20. The method as set forth in claim 18 wherein one of the temperature setting means and the mode selecting means includes a pair of predeterminately spaced apart abutments and the other of the temperature setting means and the mode selecting means includes abutment means adapted for engagement with the abutments, respectively, and wherein the adjusting and interconnection step comprises moving one of the abutment pairs and the abutment means with lost motion with respect to the other of the abutment pair and the abutment means so as to drivingly engage one of the abutments of said abutment pair and the abutment means and then conjointly driving the mode selector means from the one of the heating position and the cooling position thereof through its off position to the other of the heating position and cooling position thereof upon the adjustment of the temperature setting means from the first named preselected temperature setting toward the another preselected temperature setting thereof.

21. In a thermostat adapted to regulate the temperature of a given space in which the thermostat may be located, the thermostat having a pair of levers pivotally movable therein and arranged at least in part in adjacent relation with respect to each other with one of the levers having a heat position, an off position and a cool position defining the operating modes of the thermostat and with the other of the levers having a plurality of temperature setting positions within a pair of predetermined temperature ranges, the method of operating the thermostat comprising: pivoting the other lever from one of the temperature settings of the plurality thereof within one of the predetermined temperature ranges toward another of the temperature settings of the plurality thereof within the other of the predetermined temperature ranges and abutting the other lever during its pivotal movement from the one temperature setting toward the another temperature setting with the one lever so as to then conjointly pivot the one lever from one of the heating position and the cooling position thereof through its off position to the other of the heating position and the cooling position thereof.

22. The method as set forth in claim 21 wherein one of the one and other levers includes a pair of predeterminately spaced apart abutments and the other of the one and other levers includes abutment means movable with lost motion between said abutment pair and adapted for engagement therewith, respectively, and wherein the pivoting and abutting step comprises moving one of the abutment pair and the abutment means with lost motion with respect to the other of the abutment pair and the abutment means so as to drivingly engage one of the abutments and the abutment means during the pivotal movement of the other lever and then conjointly driving the one lever from the one of the heating position and cooling position of the one lever through its off position to the other of the heating position and cooling position thereof upon the pivotal movement of the other lever from the one temperature setting toward the another temperature setting thereof.

23. A thermostat adapted to regulate the temperature of a given space, the thermostat comprising:

means for selecting an operating mode of the thermostat and movable between a plurality of operating mode positions;

means selectively movable for setting a selected temperature within a pair of predetermined temperature ranges when said mode selecting means is in at least some of the operating mode positions thereof; and means associated with said selecting means and said temperature setting means for defining a lost motion connection therebetween, said last motion connection defining means being effective to move said mode selecting means between at least two operating mode positions of the at least some thereof through another operating mode position in response to the movement of said temperature setting means from one of the predetermined temperature ranges to the other thereof.

24. A thermostat as set forth in claim 23 wherein the at least two operating mode positions of said selecting means include a heating mode operating position and a cooling mode operating position, the another mode operating position is an off position.

25. A thermostat as set forth in claim 23 wherein said lost motion connection defining means includes a pair of spaced means on one of said mode selecting means and said temperature setting means for respective abutting engagement with a part of the other of said mode selecting means and said temperature setting means.

26. A thermostat as set forth in claim 25 further comprising means associated with said one of said mode selecting means and said temperature selecting means and with said abutting engagement means for adjusting the spacing therebetween, respectively.

* * * * *